US012584302B2

(12) United States Patent
Kang et al.

(10) Patent No.: US 12,584,302 B2
(45) Date of Patent: Mar. 24, 2026

(54) BIDET

(71) Applicant: COWAY CO., LTD., Gongju-si (KR)

(72) Inventors: Hee Joo Kang, Gongju-si (KR); Da Woon Jung, Gongju-si (KR); Hyun Kang Lee, Gongju-si (KR); Seong Min Park, Gongju-si (KR); Dong Min Oh, Gongju-si (KR); Woong Jung, Gongju-si (KR); Chan Jung Park, Gongju-si (KR)

(73) Assignee: COWAY CO., LTD., Gongju-si (KR)

( * ) Notice: Subject to any disclaimer, the term of this patent is extended or adjusted under 35 U.S.C. 154(b) by 180 days.

(21) Appl. No.: 18/555,309

(22) PCT Filed: Mar. 16, 2022

(86) PCT No.: PCT/KR2022/003670

§ 371 (c)(1),
(2) Date: Oct. 13, 2023

(87) PCT Pub. No.: WO2022/220418

PCT Pub. Date: Oct. 20, 2022

(65) Prior Publication Data

US 2024/0191486 A1 Jun. 13, 2024

(30) Foreign Application Priority Data

Apr. 15, 2021 (KR) ..... 10-2021-0049422

(51) Int. Cl.
*E03D 9/08* (2006.01)

(52) U.S. Cl.
CPC ..... *E03D 9/08* (2013.01)

(58) Field of Classification Search
CPC ..... E03D 9/08
See application file for complete search history.

(56) References Cited

U.S. PATENT DOCUMENTS 11,525,253 B2 * 12/2022 Tamura ..... E03D 9/08
2021/0040720 A1 2/2021 Tamura et al.

FOREIGN PATENT DOCUMENTS

EP 2 848 745 A1 3/2015
JP 07-023075 U 4/1995
(Continued)

OTHER PUBLICATIONS

International Search Report mailed on Jun. 28, 2022 in PCT/KR2022/003670 filed on Mar. 16, 2022 (2 pages).

*Primary Examiner* — Christine J Skubinna
(74) *Attorney, Agent, or Firm* — Oblon, McClelland, Maier & Neustadt, L.L.P.

(57) ABSTRACT

A bidet includes: a main body mounted at an upper side of a toilet bowl; a toilet seat provided to the main body and forming a seating surface on which the user sits; a cleaning nozzle coupled to the main body and spraying cleaning water to wash the user's body; a pollution prevention module provided to the main body and including an outlet for discharging pollution-preventing water; and a controller configured to control operation of the pollution prevention module. The outlet of the pollution prevention module discharges the pollution-preventing water to a front surface of the cleaning nozzle so that a surface of the main body is opened at a position spaced upward from the cleaning nozzle, and a pollution-preventing water film is discharged from the outlet into a ceramic ware of the toilet bowl to block a space between the user and the cleaning nozzle.

13 Claims, 11 Drawing Sheets

(56) References Cited

FOREIGN PATENT DOCUMENTS

| | | | | | |
|---|---|---|---|---|---|
| JP | 2004-270134 | A | | 9/2004 | |
| JP | 2005-105546 | A | | 4/2005 | |
| JP | 4693147 | B2 | * | 6/2011 | |
| JP | 2018-28193 | A | | 2/2018 | |
| JP | 2018028193 | A | * | 2/2018 | |
| JP | 2018-102371 | A | | 7/2018 | |
| JP | 2019-173287 | A | | 10/2019 | |
| KR | 10-2010-0047082 | A | | 5/2010 | |
| KR | 20100047082 | A | * | 5/2010 | ..... E03D 9/005 |
| KR | 10-2012-0086891 | A | | 8/2012 | |
| KR | 10-2020-0042772 | A | | 4/2020 | |

* cited by examiner

BIDET

CROSS-REFERENCE TO RELATED APPLICATIONS

This application claims priority to and the benefit of Korean Patent Application No. 10-2021-0049422, filed on Apr. 15, 2021, the disclosures of which is incorporated herein by reference in its entirety.

FIELD

The present disclosure relates to a bidet, and more particularly, to a bidet forming a pollution-preventing water film that prevents contamination of a cleaning nozzle.

BACKGROUND

The bidet is a device that is installed on a toilet bowl and inject a cleaning water through a nozzle provided in the bidet main body to wash an excretion organ.

As shown in FIGS. 1 and 2, the bidet 10 includes a main body 12 which is installed on the toilet bowl 1 and provided with a cleaning nozzle 14, a toilet seat 16 which is rotatably installed at the main body 12 and forms a seating surface, a toilet cover 17, and a controller which controls an operation of the cleaning nozzle 14 and a temperature of the toilet seat 16.

Meanwhile, in the case of a male, when urine is excreted, the toilet seat 16 is raised while standing in front of the toilet bowl 1, at this time, because the drop of urine is large, urine particles may splash onto an inner wall of a ceramic ware 2 or residual water remaining in the ceramic ware 2 and scatter into the cleaning nozzle 14.

Referring to Japanese Patent Laid-Open Publication No. 2018-102371, a technology is disclosed that includes an air vent forming a foldable barrier or an air curtain in the toilet seat to prevent urine particles from splashing around when urinating in an upright position and from spraying water into a bathroom when flushing the toilet water.

However, even if the air vent including the foldable barrier or the air curtain is provided, the problem of whether the contaminants mixed with water by kinetic energy of the urine in the ceramic ware 2 are attached to the cleaning nozzle 14 and cleaning nozzle 14 is contaminated or the cleaning nozzle 14 is contaminated by the urine directly directed to the cleaning nozzle 14 is not solved.

In addition, Korean Patent Laid-Open Publication No. 10-2012-0086891 discloses a technology that forms a spray group in the toilet bowl to block the odors generated from the ceramic ware, so that the excrement discharged from the body is surrounded by the spray group whenever the excrement is discharged from the body so that the odor is not diffused to the surroundings.

However, the problem of the odor blocking function using the spray group, the problem of whether the contaminants mixed with water by kinetic energy of the urine in the ceramic ware 2 are attached to the cleaning nozzle 14 and the cleaning nozzle 14 is contaminated or the cleaning nozzle 14 is contaminated by the urine stream directly directed to the cleaning nozzle 14 is not solved.

In addition, when the cleaning nozzle 14 continues to be contaminated, the odor due to dirt continues to be generated, and when it is used while stained with dirt or bacteria are growing, there is a risk of infection.

Therefore, there is a need for a bidet that can fundamentally prevent dirt from getting into the cleaning nozzle 14.

SUMMARY

In order to solve the above problem, the present disclosure provides a bidet that prevents urine from contacting the cleaning nozzle during upright urine by forming a pollution-preventing water film.

In order to achieve the above object, the bidet according to the present disclosure includes a main body mounted at an upper side of a toilet bowl, wherein a ceramic ware containing an excrement of a user is formed in the toilet bowl; a toilet seat provided to the main body and forming a seating surface on which the user sits; a cleaning nozzle coupled to the main body and spraying cleaning water to wash the user's body; a pollution prevention module provided to the main body and including an outlet for discharging pollution-preventing water to prevent contamination of the cleaning nozzle; and a controller configured to control an operation of the pollution prevention module, wherein the outlet of the pollution prevention module discharges the pollution-preventing water to a front surface of the cleaning nozzle so that a surface of the main body is opened at a position spaced upward from the cleaning nozzle, and a pollution-preventing water film is discharged from the outlet into the ceramic ware of the toilet bowl to block a space between the user and the cleaning nozzle.

In the bidet according to the embodiment of the present disclosure, the controller may be configured to control the pollution prevention module to spray the pollution-preventing water from the pollution prevention module so that the pollution-preventing water film is formed in the space spaced apart from the front surface of the cleaning nozzle.

In the bidet according to the embodiment of the present disclosure, the controller may be configured to control the pollution prevention module so that the pollution-preventing water film is formed in a form that flows down along the front surface of the cleaning nozzle.

In the bidet according to the embodiment of the present disclosure, the main body may include a protruding ledge inclined forward from the front surface of the cleaning nozzle between the cleaning nozzle and the outlet, and the pollution-preventing water discharged from the outlet may be guided by the protruding ledge and fall into the ceramic ware to form the pollution-preventing water film.

In the bidet according to the embodiment of the present disclosure, a slope of the protruding ledge may become smaller toward the lower side, and a front end of the protruding ledge may be formed in the same plane as the cleaning nozzle so that the pollution-preventing water falling from the protruding ledge flows along the front surface of the cleaning nozzle, or the pollution-preventing water falling from the protruding ledge may be spaced apart from the front surface of the cleaning nozzle.

In the bidet according to the embodiment of the present disclosure, the pollution prevention module may include a raw water inlet from which raw water is introduced; and a chamber for storing the raw water introduced from the raw water inlet.

In the bidet according to the embodiment of the present disclosure, the pollution prevention module may further include a pressing member that adjusts a pressure of the raw water introduced into the chamber.

In the bidet according to the embodiment of the present disclosure, the pollution prevention module may further include a guide member formed over the outlet to guide the flow path of the pollution-preventing water discharged from the outlet.

In the bidet according to the embodiment of the present disclosure, the pollution prevention module may further include a driving member driving the guide member, and the controller is configured to control the driving member to guide the pollution-preventing water downward by the guide member located in front of the outlet, or control the driving member to guide the pollution-preventing water forward by the guide member located over the outlet.

In the bidet according to the embodiment of the present disclosure, the outlet may have a width wider than the width of the cleaning nozzle.

In the bidet according to the embodiment of the present disclosure, the chamber may be formed to have a circular or elliptical cross-section.

In the bidet according to the embodiment of the present disclosure, the controller may be configured to control the pollution prevention module to discharge the pollution-preventing water when the toilet seat is rotated upward.

In the bidet according to the embodiment of the present disclosure, the pollution prevention module may further include a rotation detecting sensor for detecting whether the toilet seat rotates upward, and wherein the rotation detecting sensor may detect a rotational displacement of the toilet seat or detect a magnetic force of a magnet installed in any one of the toilet seat or the main body.

In the bidet according to the embodiment of the present disclosure, the controller may be configured to control the pollution prevention module to discharge the pollution-preventing water for a predetermined time from when the toilet seat rotates upward due to a change in the magnetic force of the magnet.

According to the above configuration, the bidet according to the present disclosure has an effect of improving sanitization by forming a pollution-preventing water film between a user and a cleaning nozzle, thereby blocking urine from coming into contact with the cleaning nozzle even when urinating upright.

The bidet according to the embodiment of the present disclosure has an effect of improving sanitization by blocking the contact of the urine to the cleaning nozzle when the pollution-preventing water film flows along the surface of the cleaning nozzle, and also blocking the contact of the contaminant particles scattered in the ceramic ware to the cleaning nozzle when urinating upright.

The bidet according to the embodiment of the present disclosure has an effect of improving convenience of the user by detecting the lifting of the toilet seat when urinating upright and discharges the pollution-preventing water film, thereby operating a conventional operation as a signal even when the separate switch is not operated.

DETAILED DESCRIPTION

Figure 1:
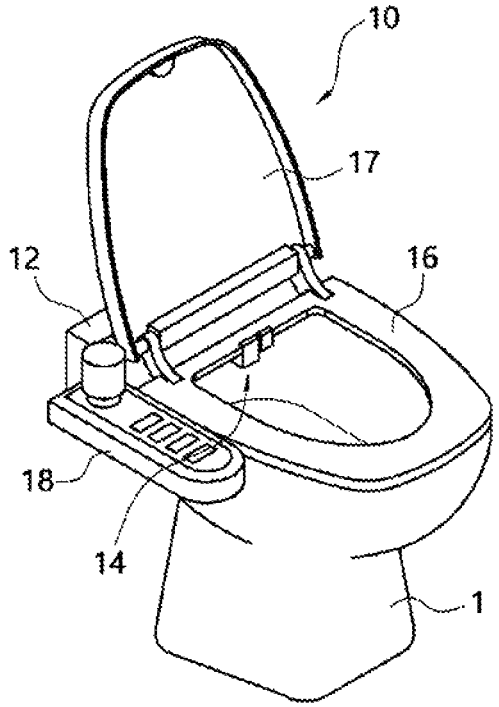
FIG. 1 is a diagram showing a toilet bowl installed with a conventional bidet.
Figure 2:
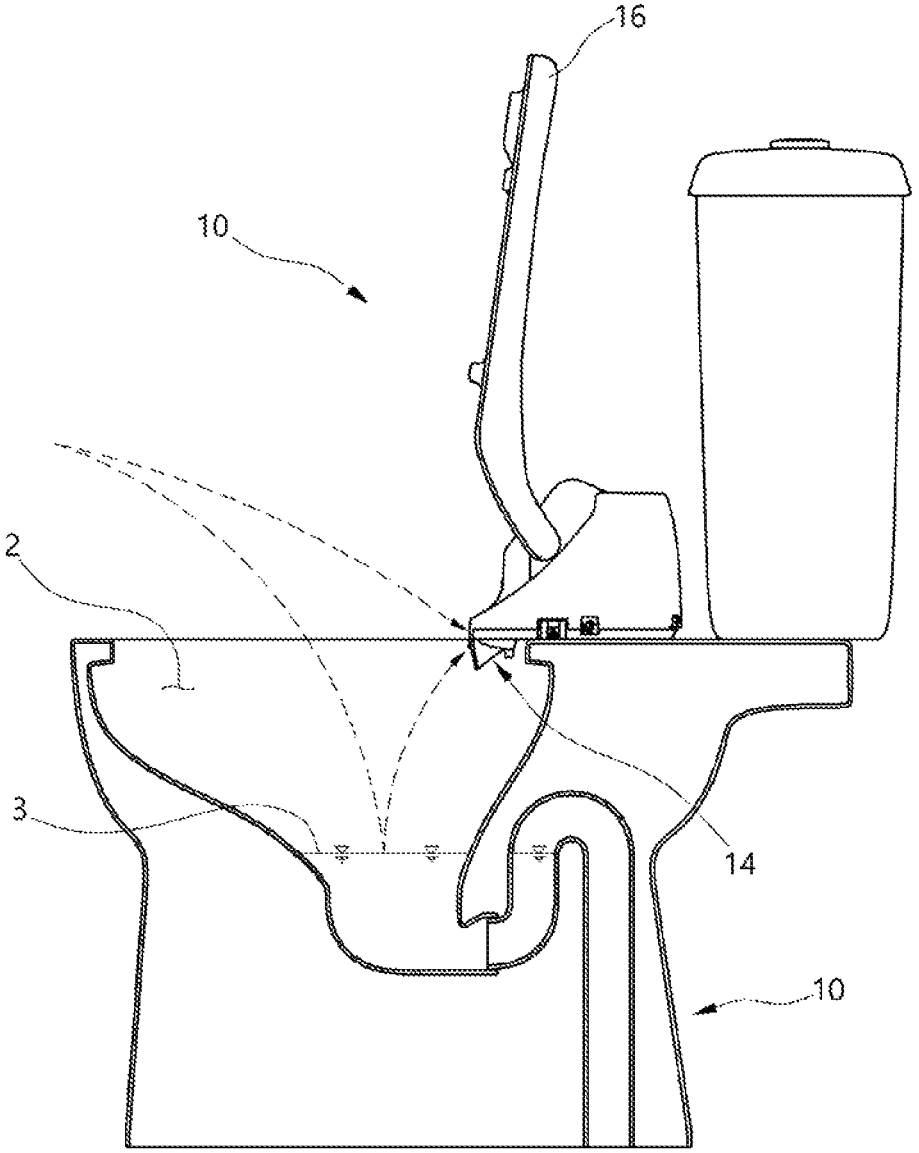
FIG. 2 is a diagram showing a case in which urine is in contact with a bidet installed in a conventional toilet bowl.

The words and terms used in the specification and claims are not interpreted as limited to ordinary or dictionary meanings, but should be interpreted as meanings and concepts consistent with the technical idea of the present disclosure according to the principle in which the inventor can define the terms and concepts in order to describe their invention in the best way.

Therefore, the configurations described in this specification and illustrated in the drawings correspond to a preferred embodiment of the present disclosure, and are not all representative of the technical idea of the present disclosure, so the corresponding configurations may be various equivalents and modifications to replace them at the time of filing of the present disclosure.

In this specification, it should be understood that the terms such as "include" or "have" are intended to describe the presence of features, numbers, steps, operations, components, parts or combinations thereof described in the specification, but do not preclude the presence or addition of one or more other features, numbers, steps, operations, components, parts or combinations thereof.

It includes not only the case that a component is disposed in the front, the rear, the upper or the lower of another component but also the case that another component is disposed in the middle therebetween unless otherwise specified. In addition, it includes not only the case that a component is "connected" to another component, unless otherwise specified, not only the case that the component is directly connected to each other but also the case that the component is indirectly connected to each other.

Hereinafter, a bed according to an embodiment of the present disclosure will be described with reference to the drawings.

Figure 3:
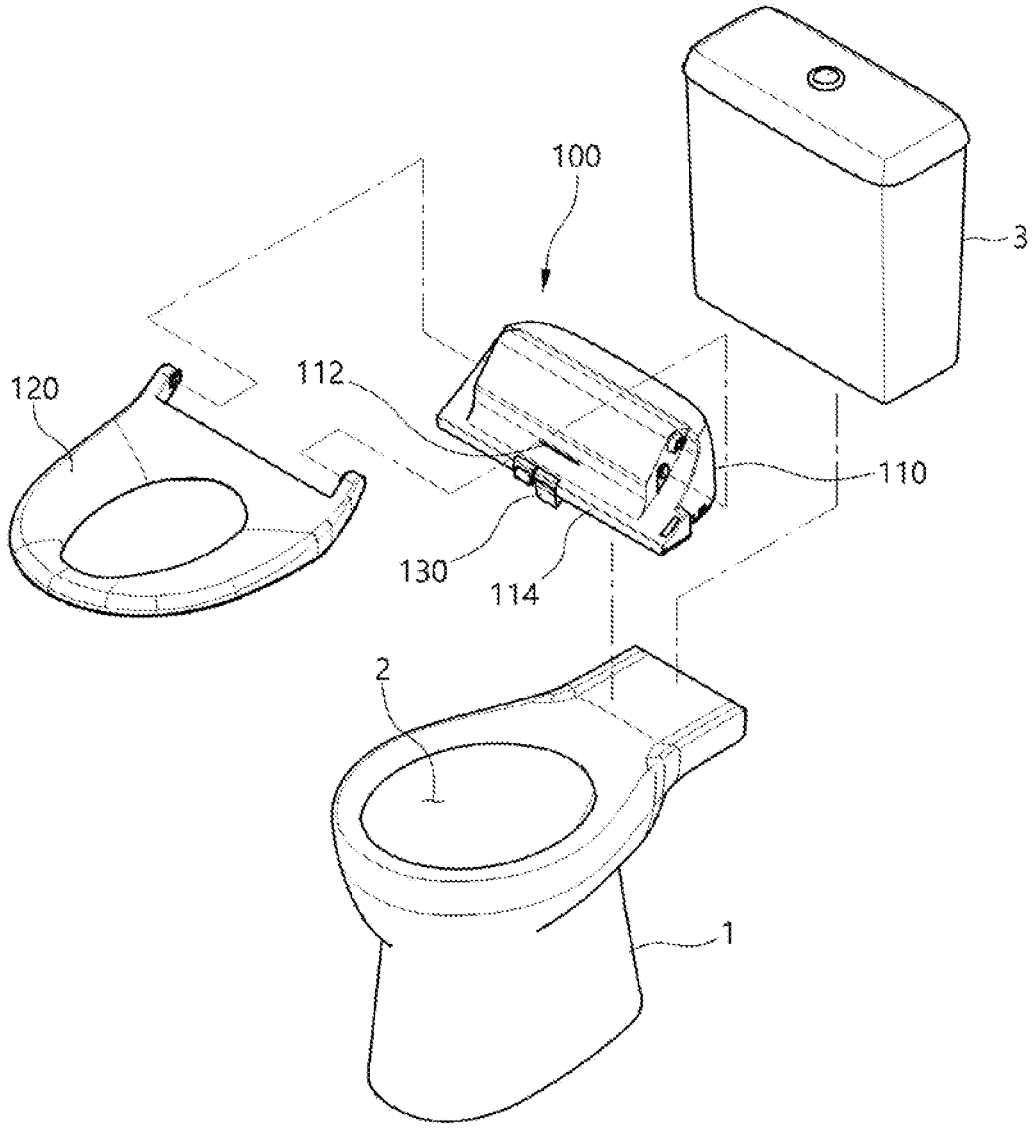
FIG. 3 is an exploded perspective view illustrating a case in which a bidet is installed in a toilet bowl according to an embodiment of the present disclosure.
Figure 4:
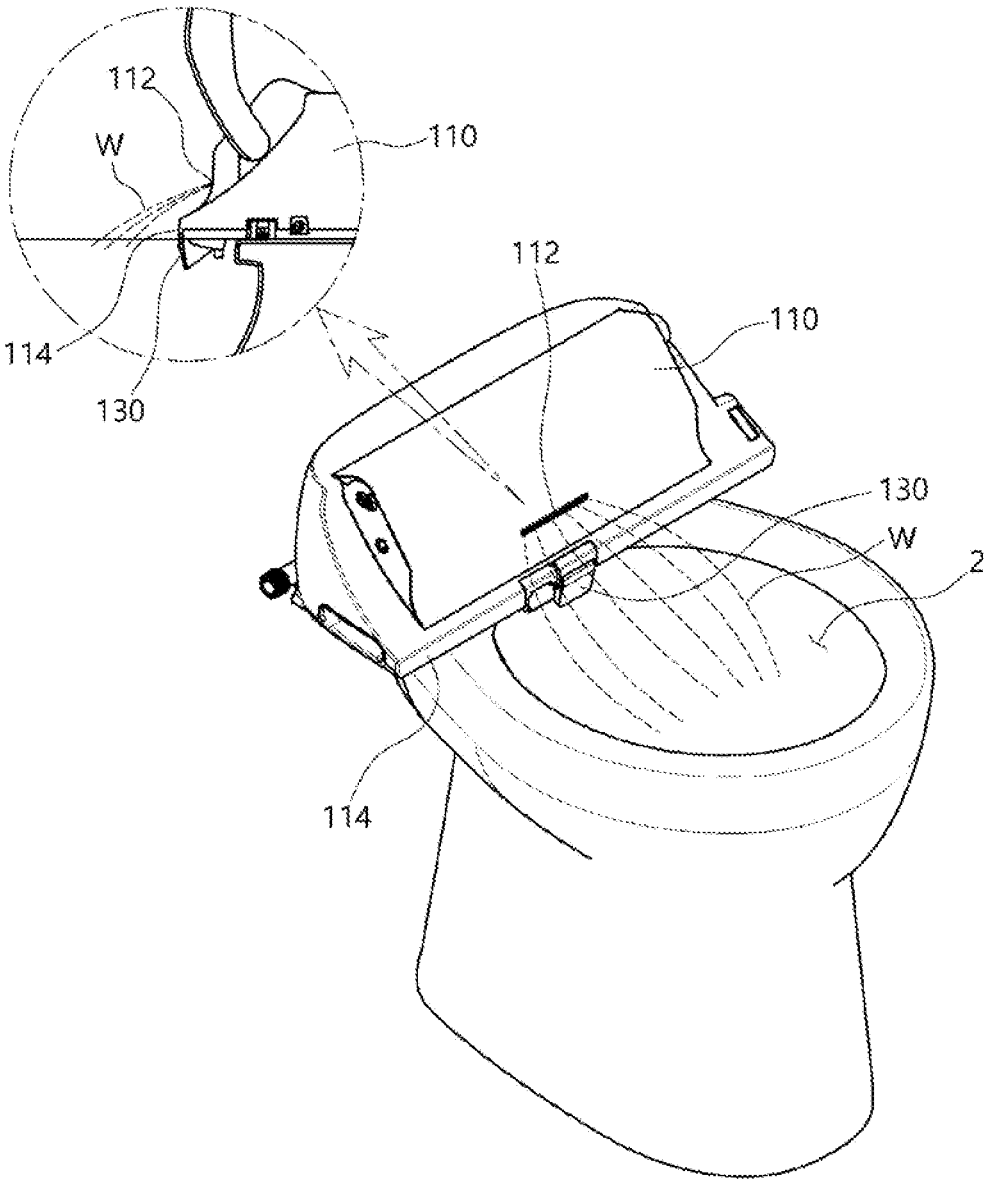
FIG. 4 is a view illustrating a case in which a pollution-preventing water film is discharged from a main body of the bidet of FIG. 3.
Figure 5:
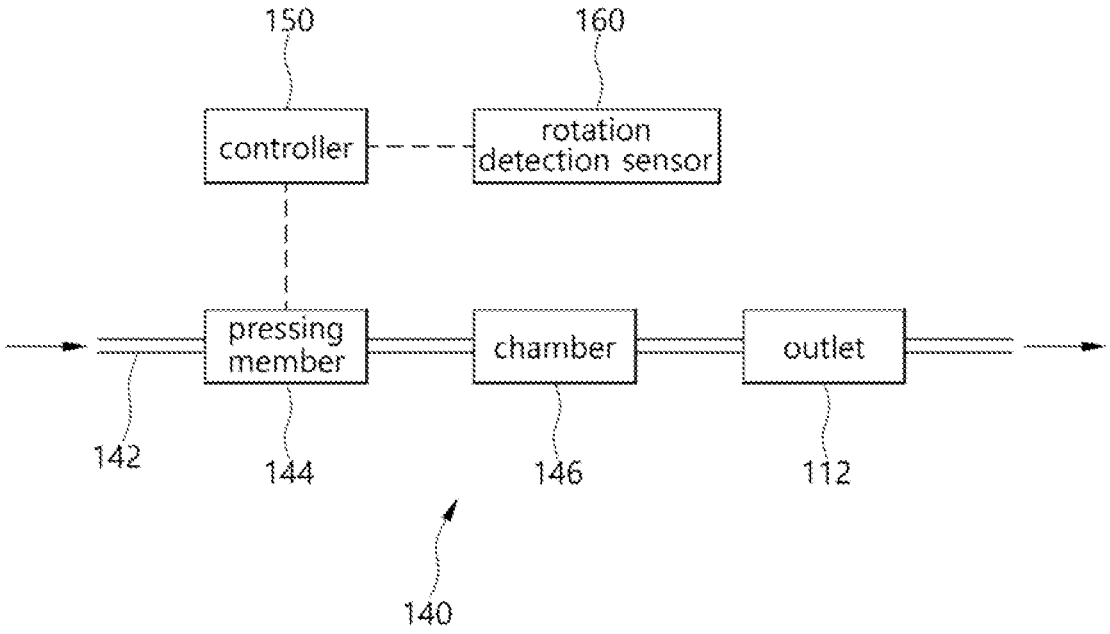
FIG. 5 is a schematic view illustrating a configuration of the bidet of FIG. 3.
Figure 6:
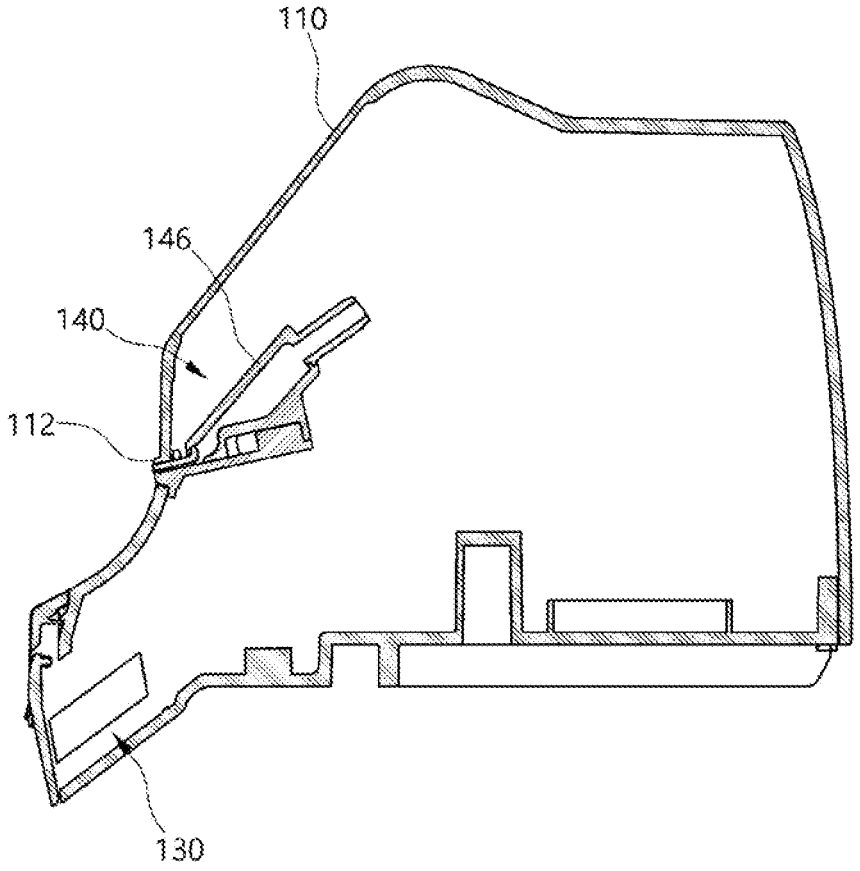
FIG. 6 is a cross-sectional view of the main body of the bidet of FIG. 3.
Figure 7:
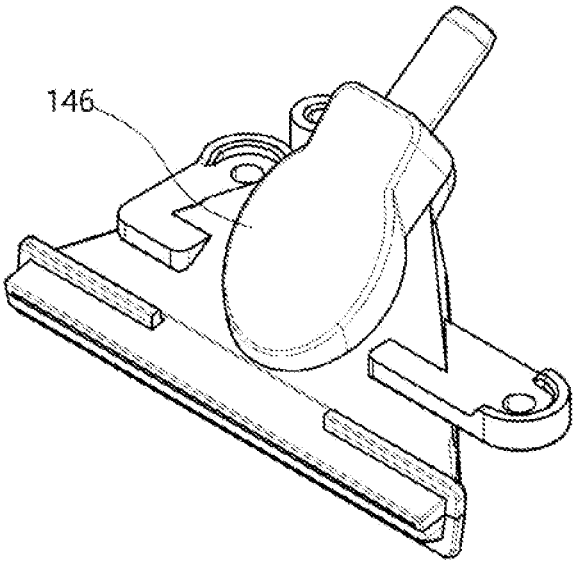
FIG. 7 is a view illustrating a chamber provided inside the main body of the bidet of FIG. 3.
Figure 8:
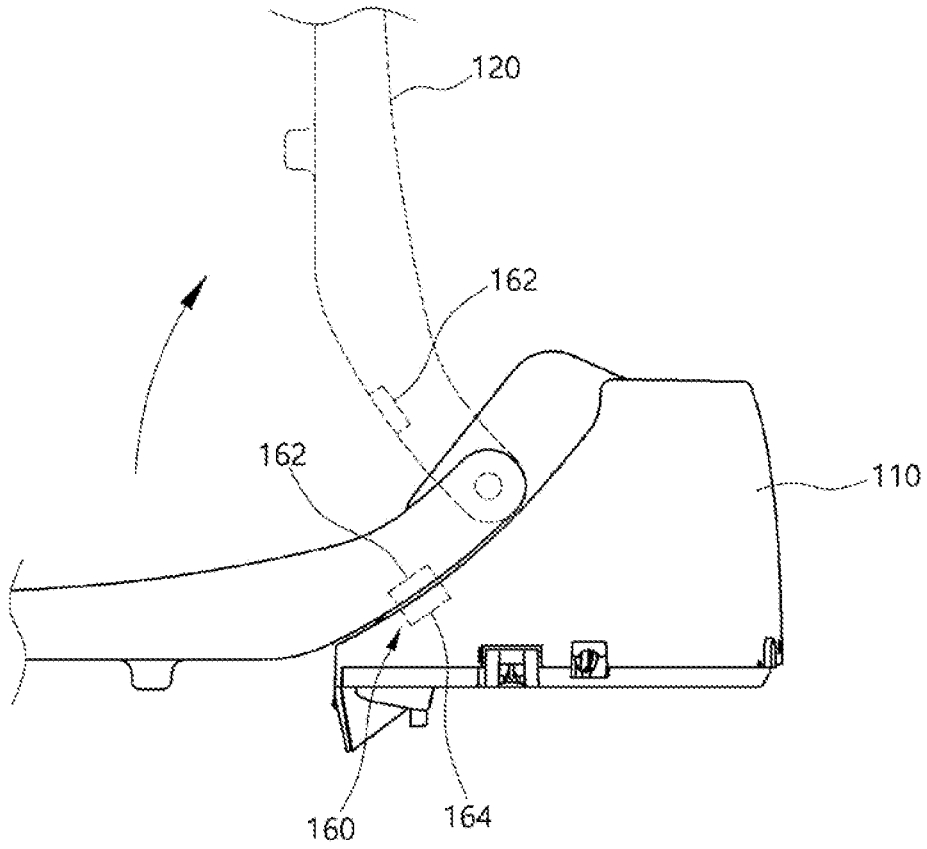
FIG. 8 is a diagram showing a case in which a toilet seat of the bidet of FIG. 3 is rotated and raised.

FIG. 3 is an exploded perspective view illustrating a case in which a bidet 100 is installed in a toilet bowl 1 according to an embodiment of the present disclosure, FIG. 4 is a view illustrating a case in which a pollution-preventing water film is discharged from a main body of the bidet, FIG. 5 is a schematic view illustrating a configuration of the bidet, FIG. 6 is a cross-sectional view of the main body of the bidet, FIG. 7 is a view illustrating a chamber provided inside the main body of the bidet, and FIG. 8 is a view illustrating a toilet seat of the bidet being rotated and raised.

As shown in FIGS. 3 to 5, the bidet 100 according to an embodiment of the present disclosure may include a main body 110, a toilet seat 120, a cleaning nozzle 130, a pollution prevention module 140, and a controller 150.

The main body 110 may be installed at an upper side of a toilet bowl 1. In general, the toilet bowl 1 is formed with a ceramic ware 2 for containing excrement of a user, the upper side of the ceramic ware 2 is opened, and a water tank 3 or a flushing lever is installed on the rear side of the ceramic ware 2, and the main body 110 may be installed on the rear side of the ceramic ware 2 at the upper side of the toilet bowl 1.

In addition, the toilet seat 120 forms a seating surface on which the user sits, and may be rotatably coupled to the main body 110 to be lifted when the user urinates or the like, and may be lowered to form the seating surface. In addition, the toilet seat 120 may be equipped with a heating function to minimize discomfort when sitting.

The cleaning nozzle 130 is provided to the main body 110, and the cleaning nozzle 130 is protruded to a lower side of the toilet seat 120 when necessary and is provided to wash a user's body by spraying cleaning water to the user's body. The cleaning nozzle 130 may be provided to a lower side of a front surface of the main body 110.

In addition, the pollution prevention module 140 may be provided to the main body 110 to discharge pollution-preventing water to prevent contamination of the cleaning nozzle 130.

The pollution prevention module 140 may be provided in the main body 110 to form a pollution-preventing water film W by discharging the pollution-preventing water, and an outlet 112 from which the pollution-preventing water is discharged may be formed in the main body 110. In this case, the outlet 112 may be formed by opening a surface of the main body 110 at a position spaced apart from an upper side of the cleaning nozzle 130 of the main body 110.

Therefore, the pollution-preventing water film W discharged from the outlet 112 is discharged from an upper side of the cleaning nozzle 130 into the ceramic ware 2 of the toilet bowl 1 to form the water film on the front surface of the cleaning nozzle 130 to block a space between the user and the cleaning nozzle 130, thereby preventing urine, etc. from being in contact with the cleaning nozzle 130 during upright urine.

In addition, the controller 150 may be provided to control an operation of the cleaning nozzle 130 and the pollution prevention module 140.

The controller 150 may control the pollution prevention module 140 to spray the pollution-preventing water from the pollution prevention module 140 so that the pollution-preventing water film W is formed in a space spaced from the front surface of the cleaning nozzle 130.

In this embodiment, the pollution-preventing water film W is discharged from the upper side of the cleaning nozzle 130 to form the water film spaced apart from the upper side and front side of the cleaning nozzle 130 as an example.

The pollution prevention module 140 may include a raw water inlet 142, a pressing member 144, and a chamber 146. The raw water inlet 142 is a portion where water is supplied to the toilet bowl 1 or the main body 110 of the bidet 100, and fresh water or heavy water may be introduced.

In order for the pollution-preventing water film W to be formed at an appropriate strength, an appropriate pressure needs to be formed. The chamber 146 temporarily stores the raw water introduced from the raw water inlet 142, and forms a predetermined pressure while temporarily storing the raw water introduced so that the pollution-preventing water discharged through the outlet 112 may be uniformly discharged for a predetermined time.

If the water pressure of fresh water or heavy water flowing through the raw water inlet 142 is not sufficient, the rate at which water fills the chamber 146 may slow down and the pressure may be low, so the pressing member 144 may be provided to pressurize the water introduced into the chamber 146. Of course, the pressing member 144 may not be provided as necessary. Alternatively, when the pressure of fresh water or heavy water introduced into the raw water inlet 142 is excessive, the pressure may be decreased to an appropriate pressure in the pressing member 144.

Meanwhile, the chamber 146 may be formed to have a circular or elliptical cross-section so that the pressure is uniformly formed inside the chamber 146.

The outlet 112 may extend from the chamber 146 and may be formed in the form of a slit having a thin thickness and a long length in the left and right width direction.

In this case, the outlet 112 may be formed to have a width wider than that of the cleaning nozzle 130. This is to ensure that the width of the pollution-preventing water film W discharged from the outlet 112 is wider than the cleaning nozzle 130.

Additionally, a protruding ledge 114 may be formed between the cleaning nozzle 130 and the outlet 112 of the main body 110, protruding inclined forward from the front surface of the cleaning nozzle 130.

Therefore, the pollution-preventing water discharged from the outlet 112 may be directly discharged from the outlet 112 into the ceramic ware 2 or guided while flowing down along the protruding ledge 114 to fall into the ceramic ware to form the pollution-preventing water film W.

The protruding ledge 114 is formed to be curved so that the slope becomes lower toward the bottom, and the front end of the protruding ledge 114 is formed in the same plane as the cleaning nozzle 130 so that the pollution-preventing water falling from the end of the protruding ledge 114 may flow down along the front surface of the cleaning nozzle 130.

Alternatively, the protruding ledge 114 may be further protruded forward than the cleaning nozzle 130 so that the pollution-preventing water falling from the protruding ledge 114 is spaced apart from the front surface of the cleaning nozzle 130.

Meanwhile, the controller 150 may control the pollution prevention module 140 to discharge the pollution-preventing water when the toilet seat 120 is tilted by being rotated upward.

In general, when a man urinates while standing up, the toilet seat 120 is tilted upwards and then urinates. When the toilet seat 120 is tilted by being rotated upwards, the controller 150 determines that there is an intention to urinate, and thus the pollution prevention module 140 may be controlled to discharge the pollution-preventing water when the toilet seat 120 is rotated upwards.

That is, a rotation detection sensor 160 is provided to detect whether the seating 120 is rotated upward. When the rotation detection sensor 160 detects that the seating 120 is rotated upward, the controller 150 controls the pollution prevention module 140 to discharge the pollution-preventing water.

This rotation detection sensor 160 may be implemented in various ways, but in this embodiment, it will be described as an example of being implemented as a magnet 162 and the magnetic force sensor 164 that detects changes in the magnetic force of the magnet 162.

As shown in FIG. 6, the rotation detection sensor 160 may include the magnetic force sensor 164 that detects the magnetic force of the magnetic 162 at a point facing the point where the magnetic 162 is installed while the magnetic 162 is installed in either the toilet seat 120 or the main body 110 and the toilet seat 120 is lowered and seated on the upper edge of the toilet bowl 1.

Therefore, in the state where the toilet seat 120 is lowered and seated on the upper edge of the toilet bowl 1, the magnetic force sensor 164 may detect the magnetic force of the magnetic 162 and in the state where the toilet seating 120 is rotated upward, the magnetic force of the magnetic 162 may not be detected. Therefore, it is possible to determine whether the toilet seat 120 is rotated as a change in magnetic force detected by the magnetic force sensor 164.

Of course, the present disclosure is not limited thereto, and it may be implemented as various structures such as the magnetic force sensor 164 may be provided at a position where magnetic force is detected when the toilet seat 120 is rotated upward. Of course, a separate lever or button for operating the pollution prevention module 140 may be provided without the rotation detection sensor 160 to determine whether or not the pollution-preventing water is discharged.

In addition, the controller 150 may control the pollution prevention module 140 to discharge the pollution-preventing water for a predetermined time from when the toilet seat 120 is detected to be rotated upward through the rotation detection sensor 160. In this case, the duration of the discharge of the pollution-preventing water may be set marginally in consideration of the average urine discharge time.

In addition, the controller 150 may control the pressure formed by the pressing member 144 of the pollution prevention module 140 to form a state in which the pollution-preventing water film W is spaced apart from the upper side and the front side of the cleaning nozzle 130 or to control the pollution-preventing water film W to flow down along the surface of the main body 110 and the protruding ledge 114.

That is, when the pressure of the pressing member 144 pressurizing the raw water is strongly formed, the pollution-preventing water film W is formed in a state that is spaced apart from the upper side and the front side of the cleaning nozzle 130, and when the pressure of the pressing member 144 pressurizing the raw water is weakly formed, the pollution-preventing water film W may be formed to flow down along the surface of the main body 110 and the protruding ledge 114 and flow down into the ceramic ware 2 along the front surface of the cleaning nozzle 130.

Therefore, when the user rotates the toilet seat 120 upward, the pollution-preventing water film W is discharged from the outlet 112 on the upper side of the cleaning nozzle 130 and is discharged into the ceramic ware 2 of the toilet bowl 1, so that the water film is formed on the front surface of the cleaning nozzle 130, thereby blocking a space between the user and the cleaning nozzle 130. Therefore, it is possible to block the user's urine from being in contact with the cleaning nozzle 130.

Hereinafter, the bidet 100 according to another embodiment of the present disclosure will be described. In the bidet 100 of the above embodiment, the pollution-preventing water film W is discharged from the upper side of the cleaning nozzle 130 to form a water film spaced apart from the upper side and the front side of the cleaning nozzle 130, but according to the bidet of the other embodiment of the present disclosure, the pollution-preventing water film W may flow down along the front surface of the cleaning nozzle 130.

Figure 9:
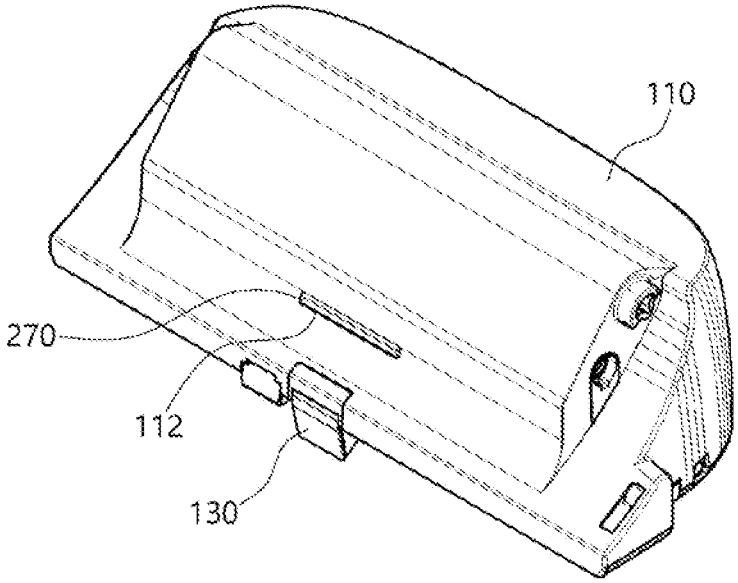
FIG. 9 is a diagram illustrating the main body of the bidet according to another embodiment of the invention.
Figure 10:
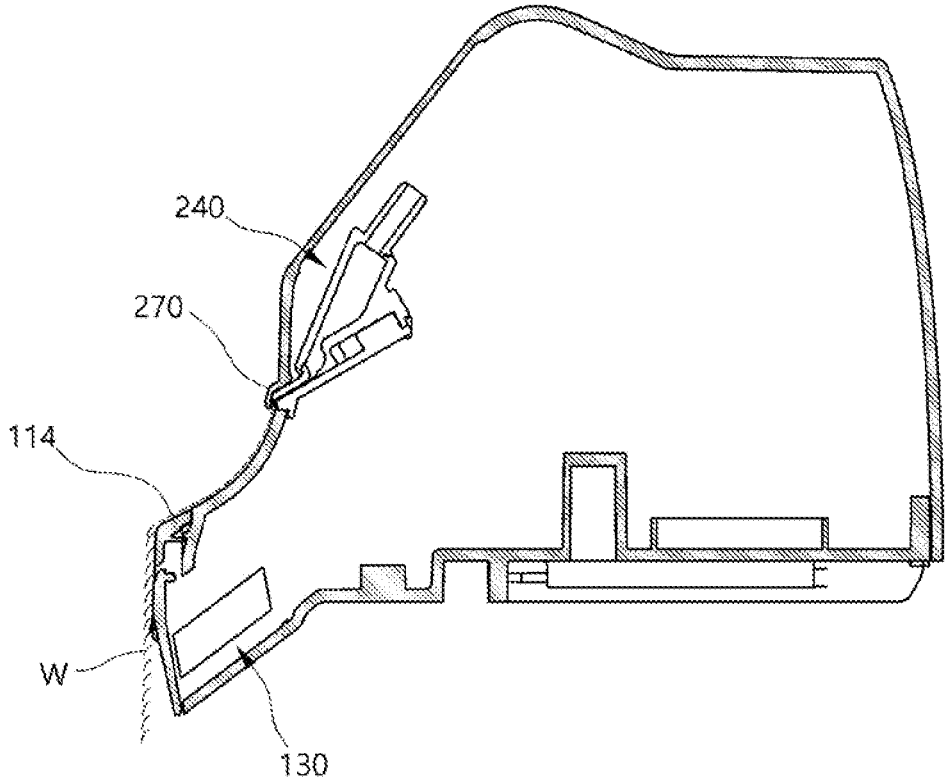
FIG. 10 is a diagram illustrating a case in which the water film is discharged from the main body of the bidet of FIG. 9.

FIG. 9 is a diagram illustrating the main body 110 of a bidet according to another embodiment of the invention, and FIG. 10 is a diagram illustrating a case in which the water film W is discharged from the bidet main body 110 of FIG. 9.

As shown in FIGS. 9 and 10, the bidet 100 according to this embodiment may include a main body 110, a toilet seat 120, a cleaning nozzle 130, a pollution prevention module 240, and a controller 150.

Here, the main body 110, the toilet seat 120, the cleaning nozzle 130, and the controller 150 are the same as in the above-described embodiment, and thus detailed descriptions will be omitted.

The pollution prevention module 240 may be provided in the main body 110 to discharge pollution-preventing water to prevent contamination of the cleaning nozzle 130 similar to the above-described embodiment.

In addition, an outlet 112 through which the pollution-preventing water is discharged may be formed in the main body 110. In this case, the outlet 112 may be formed by opening the surface of the main body 110 at a position spaced apart from the upper side of the cleaning nozzle 130 of the main body 110.

In addition, the pollution prevention module 240 may further include a guide member 270. The guide member 270 is formed on the upper side of the outlet 112, and the pollution-preventing water discharged from the outlet 112 may flow along the surface of the main body 110 to flow along the front surface of the cleaning nozzle 130 and guide the pollution-preventing water to fall into the ceramic ware 2 of the toilet bowl 1.

The guide member 270 is located on the upper side of the outlet 112, and is bent in the form of "F" on the front surface of the outlet 112, so that the front surface and the upper side are closed and open downwards, so that the pollution-preventing water discharged from the outlet 112 may be guided downwards by the guide member 270 located at the front surface of the outlet 112 to flow along the surface of the main body 110.

In addition, a protruding ledge 114 protruding forwardly from the front surface of the cleaning nozzle 130 is formed between the cleaning nozzle 130 and the outlet 112 of the main body 110. The pollution-preventing water discharged from the outlet 112 may be directly discharged from the outlet 112 into the ceramic ware 2 or guided while flowing down along the protruding ledge 114 to form the pollution-preventing water film W while falling into the ceramic ware 2.

The protruding ledge 114 is formed to be curved so that the slope becomes smaller toward a lower side, and a front end of the protruding ledge 114 is formed in the same plane as the cleaning nozzle 130 so that the pollution-preventing water falling from the end of the protruding ledge 114 flows down along the front surface of the cleaning nozzle 130.

Alternatively, the protruding ledge 114 may further protrude forward than the cleaning nozzle 130 so that the pollution-preventing water falling from the end of the protruding ledge 114 is spaced apart from the front surface of the cleaning nozzle 130.

Therefore, it is possible to prevent the user's urine from being in contact with the cleaning nozzle 130, or it is also possible to prevent the urine from falling into the water in the ceramic ware 2 and scattering contaminant particles on the cleaning nozzle 130.

Hereinafter, a bidet according to another embodiment of the present disclosure will be described.

Figure 11:
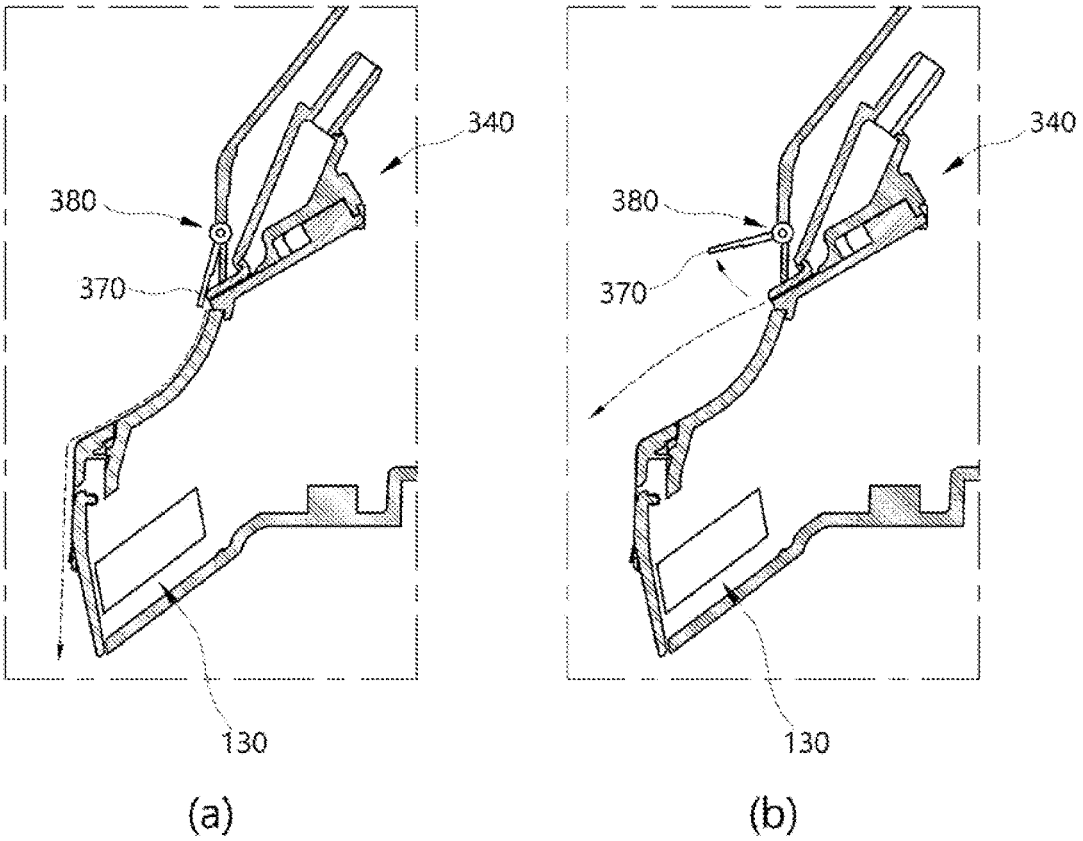
FIG. 11 is a cross-sectional view illustrating a guide member driven by a driving member in the main body of the bidet of another embodiment of the present disclosure.

FIG. 11 is a diagram illustrating a bidet different from another embodiment of the present disclosure.

Since the bidet according to this embodiment differs from the above-described embodiment in the pollution prevention module 340, the pollution prevention module 340, which differs from the bidet 100 of the above-described embodiment, will be described only in the following description.

The pollution prevention module 340 may include a raw water inlet 142 (see FIG. 5), a chamber 146, a guide member 370, and a driving member 380.

In addition, the raw water inlet 142, the chamber 146, and the like are the same as the bidet 100 according to the above-described embodiment, and thus description is omitted.

The guide member 370 may be movably provided at the outlet 112 of the main body 110 and located at the front side of the outlet 112 or provided over the outlet 112.

In addition, the guide member 370 may be formed in the form of "-".

In addition, the guide member 370 may be rotatably provided at the outlet 112, and whether to rotate may be controlled by the controller 150.

As shown in (a) of FIG. 11, when the guide member 370 is rotated downward and located in front of the outlet 112, the pollution-preventing water may flow down along the front surface of the cleaning nozzle 130 and be guided downward to fall into the ceramic ware 2.

In addition, as shown in (a) of FIG. 11, when the guide member 370 is rotated upward and positioned at the upper side of the outlet 112, the pollution-preventing water discharged from the outlet 112 may be guided toward the front side by the guide member 370 positioned at the upper side of the outlet 112 and fall into the ceramic ware 2 to form the pollution-preventing water film W.

The driving member 380 may control the position of the guide member 370 under the control of the controller 150.

The driving member 380 may include a motor (not shown). That is, a rotary shaft of the motor may be directly connected to a rotary shaft of the guide member 370, or a separate power transmission mechanism may transmit the rotational force of the motor to the guide member 370 so that the guide member 370 is rotated upwards of the outlet 112 to be separated from the front side of the outlet 112 or rotated downwards to be located in the front side of the outlet 112.

Therefore, the user may select the form of the pollution prevention water film W according to the person's taste, thereby improving convenience of use.

Although the embodiments of the present disclosure are described, the spirit of the present disclosure is not limited by the embodiments presented in this specification, and those skilled in the art who understand the spirit of the present disclosure may easily propose other embodiments by adding, changing, deleting, adding, etc., components within the same spirit, but this is also within the scope of the present disclosure.

What is claimed is:

1. A bidet, comprising:

a main body mounted at an upper side of a toilet bowl, wherein a ceramic ware containing an excrement of a user is formed in the toilet bowl;

a toilet seat provided to the main body and forming a seating surface on which the user sits;

a cleaning nozzle coupled to the main body and spraying cleaning water to wash the user's body;

a pollution prevention module provided to the main body and including an outlet for discharging pollution-preventing water to prevent contamination of the cleaning nozzle; and a controller configured to control an operation of the pollution prevention module, wherein the outlet of the pollution prevention module discharges the pollution-preventing water to a front surface of the cleaning nozzle so that a surface of the main body is opened at a position spaced upward from the cleaning nozzle, and a pollution-preventing water film is discharged from the outlet into the ceramic ware of the toilet bowl to block a space between the user and the cleaning nozzle, and wherein the controller is configured to control the pollution prevention module to discharge the pollution-preventing water when the toilet seat is rotated upward.

2. The bidet of claim 1, wherein the controller is configured to control the pollution prevention module to spray the pollution-preventing water from the pollution prevention module so that the pollution-preventing water film is formed in the space spaced apart from the front surface of the cleaning nozzle.

3. The bidet of claim 1, wherein the controller is configured to control the pollution prevention module so that the pollution-preventing water film is formed in a form that flows down along the front surface of the cleaning nozzle.

4. The bidet of claim 1, wherein the main body comprises a protruding ledge inclined forward from the front surface of the cleaning nozzle between the cleaning nozzle and the outlet, and the pollution-preventing water discharged from the outlet is guided by the protruding ledge and falls into the ceramic ware to form the pollution-preventing water film.

5. The bidet of claim 4, wherein a slope of the protruding ledge becomes smaller toward the lower side, and a front end of the protruding ledge is formed in the same plane as the cleaning nozzle so that the pollution-preventing water falling from the protruding ledge flows along the front surface of the cleaning nozzle, or the pollution-preventing water falling from the protruding ledge is spaced apart from the front surface of the cleaning nozzle.

6. The bidet of claim 1, wherein the pollution prevention module comprises:

a raw water inlet from which raw water is introduced; and a chamber for storing the raw water introduced from the raw water inlet.

7. The bidet of claim 6, wherein the pollution prevention module further comprises:

a guide member formed over the outlet to guide the flow path of the pollution-preventing water discharged from the outlet.

8. The bidet of claim 7, wherein the pollution prevention module further comprises:

a driving member driving the guide member, and the controller is configured to:

control the driving member to guide the pollution-preventing water downward by the guide member located in front of the outlet, or control the driving member to guide the pollution-preventing water forward by the guide member located over the outlet.

9. The bidet of claim 6, wherein the outlet has a width wider than the width of the cleaning nozzle.

10. The bidet of claim 6, wherein the chamber is formed to have a circular or elliptical cross-section.

11. The bidet of claim 1, wherein the pollution prevention module further comprises:

a rotation detecting sensor for detecting whether the toilet seat rotates upward, and wherein the rotation detecting sensor detects a rotational displacement of the toilet seat or detects a magnetic force of a magnet installed in any one of the toilet seat or the main body.

12. The bidet of claim 11, wherein the controller is configured to control the pollution prevention module to discharge the pollution-preventing water for a predetermined time from when the toilet seat rotates upward due to a change in the magnetic force of the magnet.

13. The bidet of claim 7, wherein the guide member is located on an upper side of the outlet and is bent in a F-shape on a front surface of the outlet such that the upper side of the outlet and the front surface of the outlet are closed and open downwards.

* * * * *